US005385309A

United States Patent [19]

Bielagus

[11] Patent Number: 5,385,309

[45] Date of Patent: Jan. 31, 1995

[54] SEGMENTED WOOD CHIP CRACKING ROLL

[75] Inventor: Joseph B. Bielagus, Tualatin, Oreg.

[73] Assignee: Beloit Technologies, Inc., Wilmington, Del.

[21] Appl. No.: 153,251

[22] Filed: Nov. 16, 1993

[51] Int. Cl.[6] ..... B02C 1/08; B27M 1/02

[52] U.S. Cl. ..... 241/235; 100/121; 100/176; 100/902; 144/2 R; 144/362; 492/33

[58] Field of Search ..... 241/114, 117, 235, 250–253, 241/257, 261.3, 278, 298; 100/98 R, 121, 176, 902; 492/33–38; 144/2 R, 2 J, 209 R, 362

[56] References Cited

U.S. PATENT DOCUMENTS

| | | | |
|---|---|---|---|
| 3,438 | 2/1844 | Battin . | |
| 1,980,193 | 2/1934 | Finegan . | |
| 3,387,795 | 6/1968 | Bidwell . | |
| 3,393,634 | 7/1968 | Blackford . | |
| 3,406,624 | 10/1968 | Kutchera et al. . | |
| 4,050,980 | 9/1977 | Schmidt et al. . | |
| 4,235,382 | 11/1980 | Smith . | |
| 4,718,338 | 1/1988 | Koba | 144/362 |
| 4,723,718 | 2/1988 | LaPointe . | |
| 4,790,360 | 12/1988 | Clarke et al. . | |
| 4,850,404 | 7/1989 | Koba | 144/362 |
| 4,903,845 | 2/1990 | Artiano . | |
| 4,953,795 | 9/1990 | Bielagus . | |
| 5,179,986 | 1/1993 | Beuving et al. | 144/362 |
| 5,234,040 | 8/1993 | Koba | 144/362 |

FOREIGN PATENT DOCUMENTS

| | | |
|---|---|---|
| 0153537 | 9/1903 | Austria . |
| 0825416 | 10/1969 | Canada . |
| 1174092 | 11/1984 | Canada . |
| 0328067 | 8/1989 | European Pat. Off. . |
| 0020863 | 11/1963 | Finland . |
| 2113572 | 5/1972 | France . |
| 0720190 | 4/1942 | Germany . |
| 2333727 | 2/1975 | Germany . |
| 0261753 | 12/1927 | United Kingdom . |
| 0406262 | 5/1932 | United Kingdom . |
| 1037946 | 8/1983 | U.S.S.R. . |
| 9004672 | 5/1990 | WIPO . |

OTHER PUBLICATIONS

Lachenal, Monzi & deChoudens "Chip Destructuring Improves Kraft Pulping", TAPPI Pulping Conf. Nov. 12–14, 1984, Book I pp. 13–17.

Oldham, "A Machine For Destructuring Wood Chips By Rolling", Appita, vol. 1, No. 37, pp. 65–69.

Henry "Conditioning Of Over-Thick Wood Chips, An Alternative to Chip Slicing" Presented Mar. 25, 1993.

*Primary Examiner*—W. Donald Bray

*Attorney, Agent, or Firm*—Dirk J. Veneman; Raymond W. Campbell

[57] ABSTRACT

A wood chip cracking device for use in papermaking employs closely spaced, oppositely rotating rolls which have pyramid-shaped projections on the roll surfaces. This chip destructuring apparatus is rendered readily serviceable with minimal downtime by constructing the roll surface of removable segments which are bolted to a central rotatable shaft. The segments are sized so they can be lifted by a service man. As damage to the roll surface, such as by exposure to tramp metal, is typically limited to a single segment, service and repair of the roll is expedited by permitting removal of a single damaged segment without removing the remaining undamaged segments. Each sector is bored for twelve bolts and is affixed to the central axis by twelve recessed bolts. The surface segments allow the surface to be replaced without removing the rolls from the frame of the wood chip cracking device.

5 Claims, 3 Drawing Sheets

SEGMENTED WOOD CHIP CRACKING ROLL

FIELD OF THE INVENTION

The present invention relates to an apparatus for treating wood chips to enhance liquor penetration in subsequent pulping operations. More particularly, the present invention relates to the rolls of a destructuring apparatus in which chips are passed between closely spaced rolls having surfaces that are aggressively contoured, for causing chips to be cracked by compressive forces.

BACKGROUND OF THE INVENTION

In the production of paper from wood fibers, the wood fibers must be freed from the raw wood. In one widely used method, this is accomplished by cooking the wood fibers in a solution until the material holding the fibers together, lignin, is dissolved. In order to achieve rapid and uniform digestion by the cooking liquor, the wood, after it has been debarked, is passed through a chipper, which reduces the raw wood to chips on the order of one inch to four inches long. The chipper tends to produce a large percentage of over-thick chips which, after separation by a screen, must normally be reprocessed through a slicer to reduce them to the desired thickness. This reprocessing through a slicer has the undesirable effect of creating excessive fines and pins. The production of fines and pins reduces the overall yield of high quality fibers from a given amount of raw wood. Because the cost of the raw wood is a major contributor to the cost of paper produced, reslicing the oversized chips incurs a considerable cost.

A long studied but only recently commercialized alternative to reslicing over-thick wood chips is a process known as "destructuring" the chips. The chips are fed through opposed rollers which compress the chips as they pass through the nip of the rollers. The compression of the chip results in longitudinal fractures along the grain and fractures across the grain of the wood. The cracks induced in the chips allow the cooking liquor to penetrate the interior of the chip, thus effectively reducing the chip's thickness. However, the cross-grain cracking results in fibers that produce a paper with lower strength characteristics. For this reason, it is desirable to induce only longitudinal cracks along the grain of the chips.

My earlier U.S. Pat. No. 4,953,795 discloses an apparatus employing aggressively contoured roll surfaces consisting of a matrix of pyramid projections on the roll surfaces. My earlier patent teaches rolls which destructure the wood chips by cracking them preferentially in the direction of the grain.

The use, as disclosed in my earlier patent, of aggressively contoured roll surfaces having a matrix of outwardly extending discrete projections has proven critical to the practical utilization of the chip destructuring process for the preparation of wood chips. Although apparatus to remove tramp metal and other noncompressible articles from the wood chip flow will always be employed, on rare occasions such materials may find their way between the destructuring rolls. As the aggressively contoured roll surfaces are expensive to fabricate it would be desirable to provide rolls which have some endurance when subjected to unexpectedly hard objects. Furthermore, the surfaces, if damaged, should be replaceable with a minimum of down time.

SUMMARY OF THE INVENTION

The aggressively surfaced roll of this invention is employed in a chip destructuring device. The chip destructuring device employs closely spaced, oppositely rotating rolls having matrices of pyramid-shaped projections formed into their surfaces. The opposed rolls form a nip through which oversized wood chips are passed. The chips are compressed between the rolls, producing cracks along the grain of the wood in the chips.

During operation of the chip destructuring apparatus, the only component of the apparatus that comes in contact with the wood chips are the roll surfaces on which the pyramidal pattern is machined. The roll surfaces which come in contact with the chips are subject to wear and occasional damage from tramp metal. The chip destructuring apparatus is rendered readily serviceable with minimal down time by constructing the roll surface out of segments which are bolted to a central rotating shaft. The segments are sized so they can be lifted by a single serviceman. A polyurethane backing is positioned between each segment and an inner shell. This backing provides shock absorbing capability to the roll surfaces which improves the endurance of the surface. Furthermore, the construction of the roll surface in segments allows removal of a single segment to which damage caused by tramp metal is normally limited.

The roll segments are manufactured from a spun-cast 4140 steel cylindrical casting which is machined on the inside to match the central shaft, and is machined on the outside to an aggressive contour formed by an array of pyramid-shaped projections. Twelve inch segments of roll are then cut into four cylindrical sectors. Each sector is bored for twelve bolts and is affixed to the central axis by twelve recessed bolts.

It is an object of the present invention to provide a roll surface for a chip destructuring apparatus which has improved endurance and which may be readily replaced.

It is another object of the present invention to minimize down time in the papermaking process.

It is further object of the present invention to provide a roll in a chip destructuring apparatus which will give when subjected to above normal loads.

Further objects, features, and advantages of the invention will be apparent from the following detailed description when taken in conjunction with the accompanying drawings.

DESCRIPTION OF THE PREFERRED EMBODIMENT

Figure 1:
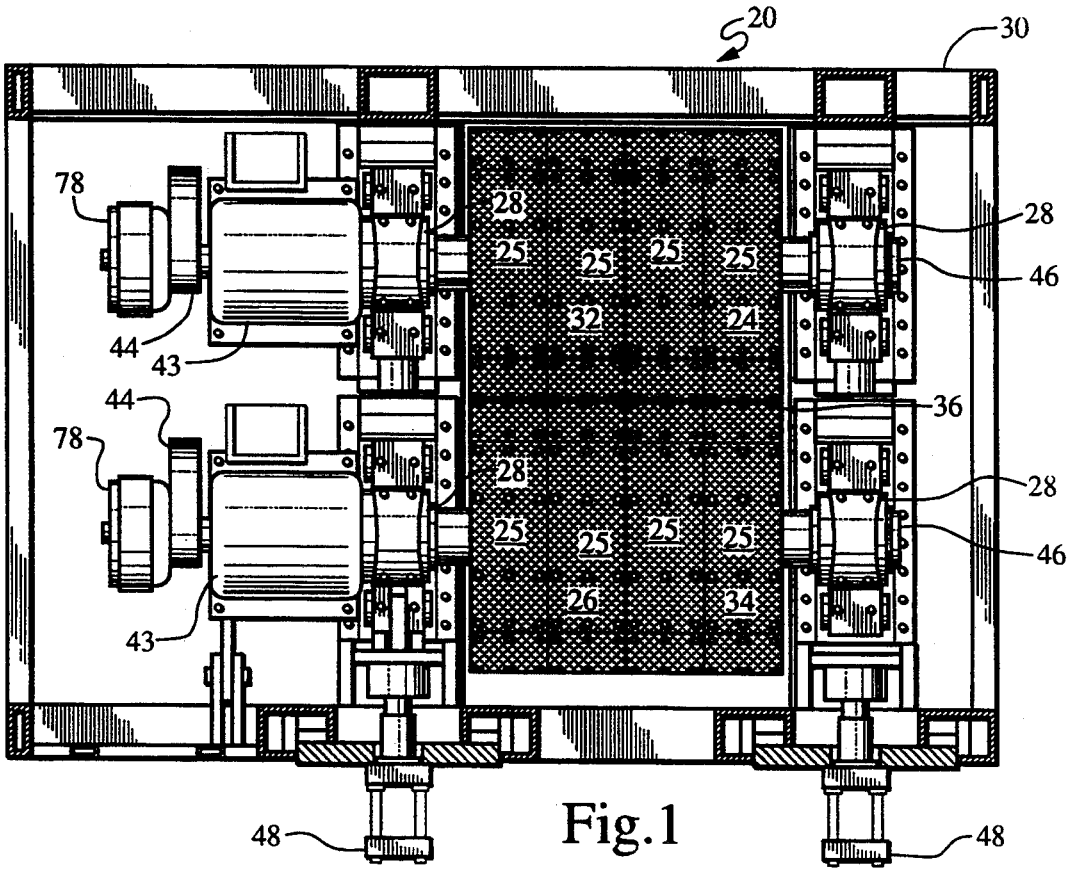
FIG. 1 is a top plan view, partly cut away, of a wood chip cracking apparatus employing rolls with segmented surface plates of this invention taken along section line 1—1 of FIG. 2.
Figure 2:
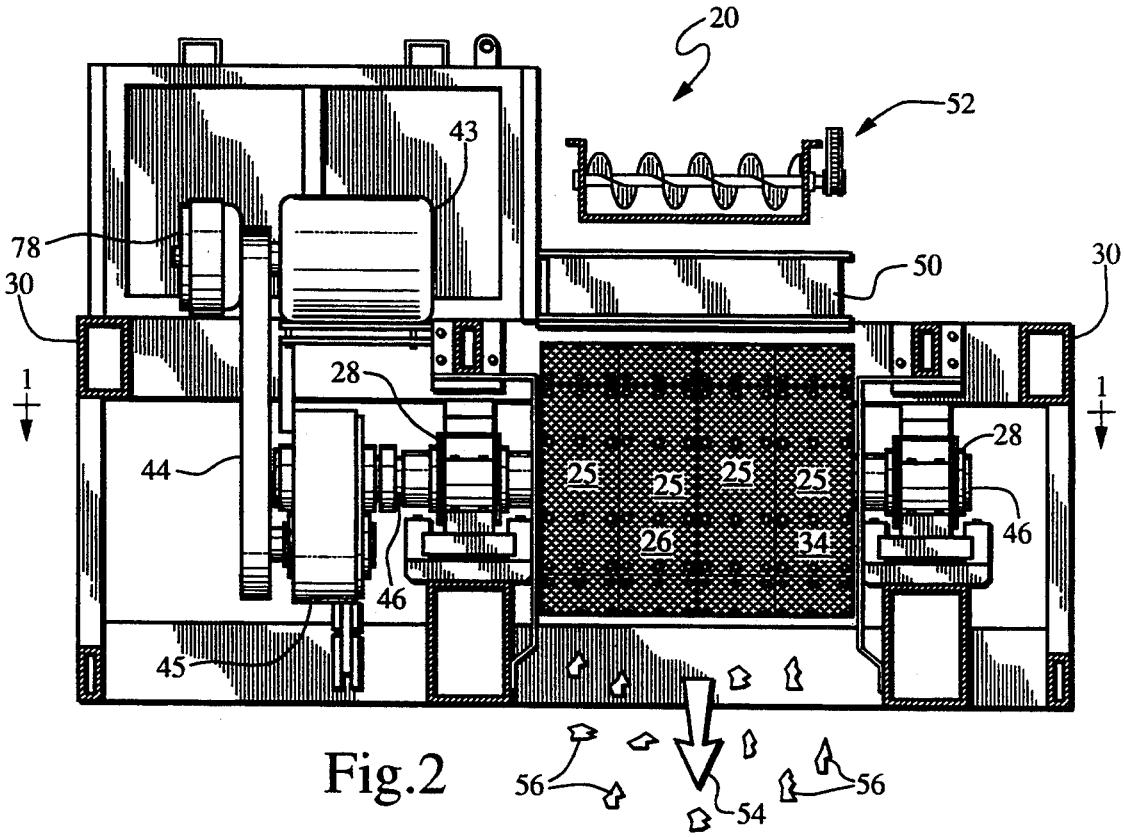
FIG. 2 is a cross-sectional view taken along section line 2—2 of the wood chip cracking apparatus of FIG. 1.
Figure 3:
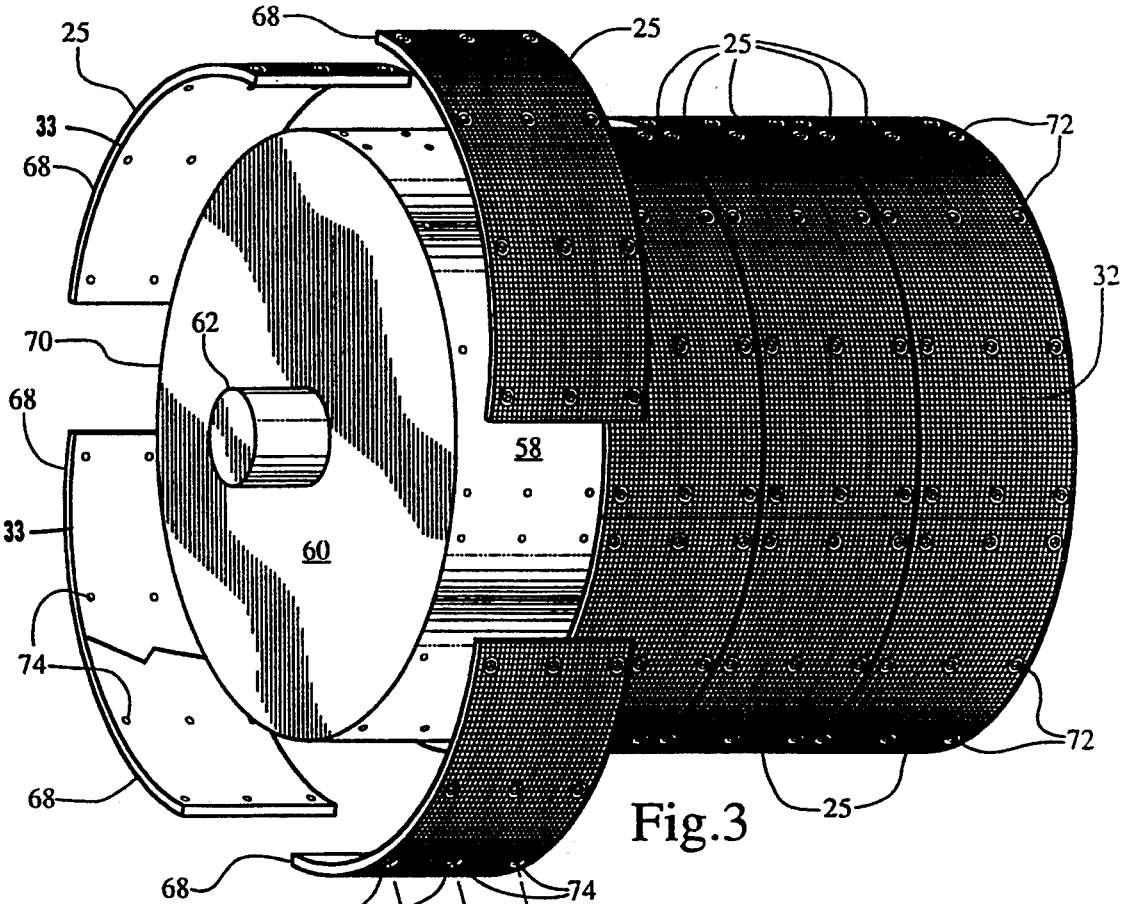
FIG. 3 is an exploded isometric view of the roll employed in the chip cracking apparatus of FIG. 1.
Figure 4:
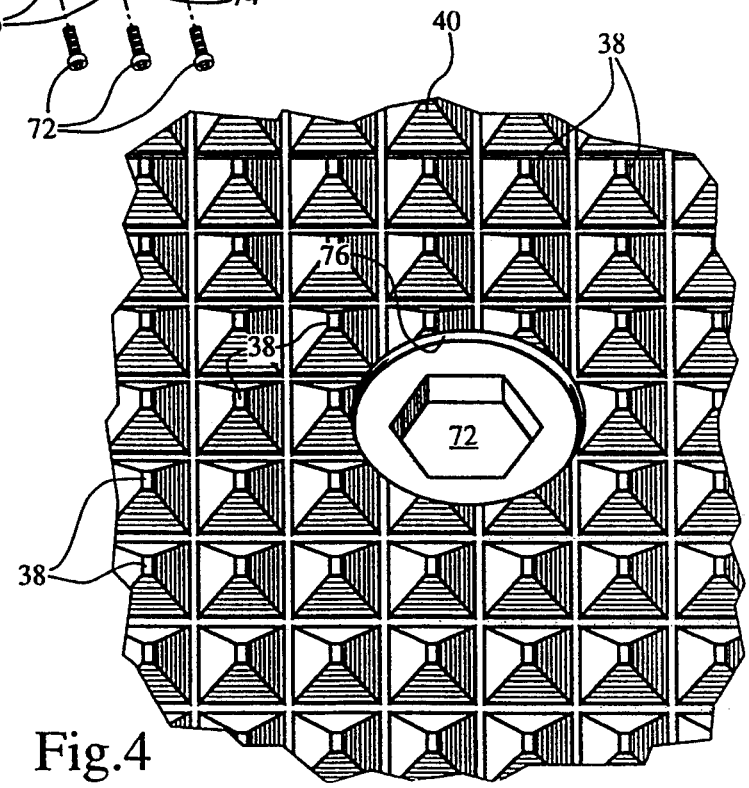
FIG. 4 is a fragmentary isometric view of a surface segment showing a bolt which holds the surface segments to the inner shell.

Referring more particularly to FIGS. 1-6, wherein like numbers refer to similar parts, the chip conditioner 20, shown in FIG. 1 has a first roll 24 and a second roll 26 which are mounted for rotation by bearings 28 to the frame 30. The rolls 24, 26 have aggressively contoured surfaces 32, 34 comprised of removable surface segments 25 mounted to inner shells 58, best shown in FIG. 3. A resilient backing material 33 is positioned between the segments 25 and the shell 58 to which they are connected. The rolls 24 and 26 counter-rotate in spaced parallel relation to form a nip 36. As best shown in FIGS. 3 and 4, the aggressive contoured surface of the roll is preferably composed of pyramids 38, which are arranged in circumferential rows 40 to form the aggressive surfaces 32, 34, of the rolls 24, 26. In a preferred embodiment, the peaks of the pyramids 38 are spaced one-half inch apart, and the depth of the machining from the peak to the base of the individual pyramids 38 is approximately a quarter inch. In operation, the peaks of the pyramids 38 rotating through the nip 36 may be placed in a peak-to-peak orientation or in a peak-to-valley orientation. In use, the pyramids 38 cause the chips 56 to be fractured along the direction of the grain, which is the direction of fiber orientation in the wood chips 56.

The shape and operation of the aggressively contoured surfaces 32, 34 are more fully explained in my earlier U.S. Pat. No. 4,953,79,5 issued Sep. 4, 1990, which is incorporated herein by reference.

The chip conditioner 20 has electric motors 43 which drive speed reducers 45 by matched V-belts 44. The speed reducers 45 are connected to the central drive shaft 46 of the rolls 24, 26.

The roll 26, together with its bearings 28 and speed reducer 44, is horizontally adjustable by means of hydraulic actuators 48. The actuators control the width of the nip 36 by moving the roll 26 in spaced, parallel relation to the opposed roll 24. The hydraulic actuators 48 also allow the rolls 24, 26 to separate in response to a foreign object such as tramp metal, and so decrease the likelihood of damage to the roll surfaces.

Chips 56 to be processed are fed through a chip feed 50 mounted over the nip 36 formed between the rolls 24, 26. The chip feed 50 is located above the nip 36 and is supplied with chips 56 by an auger 52 shown in FIG. 2.

Other means for supplying chips including a hopper, a conventional conveyor, a vibrating conveyor or chute, etc., may be used so long as the chips are distributed evenly along the nip 36. Even distribution of the chips 56 along the nip 36 is important to fully utilize the entire length of the rolls, without overloading any part thereof.

Figure 5:
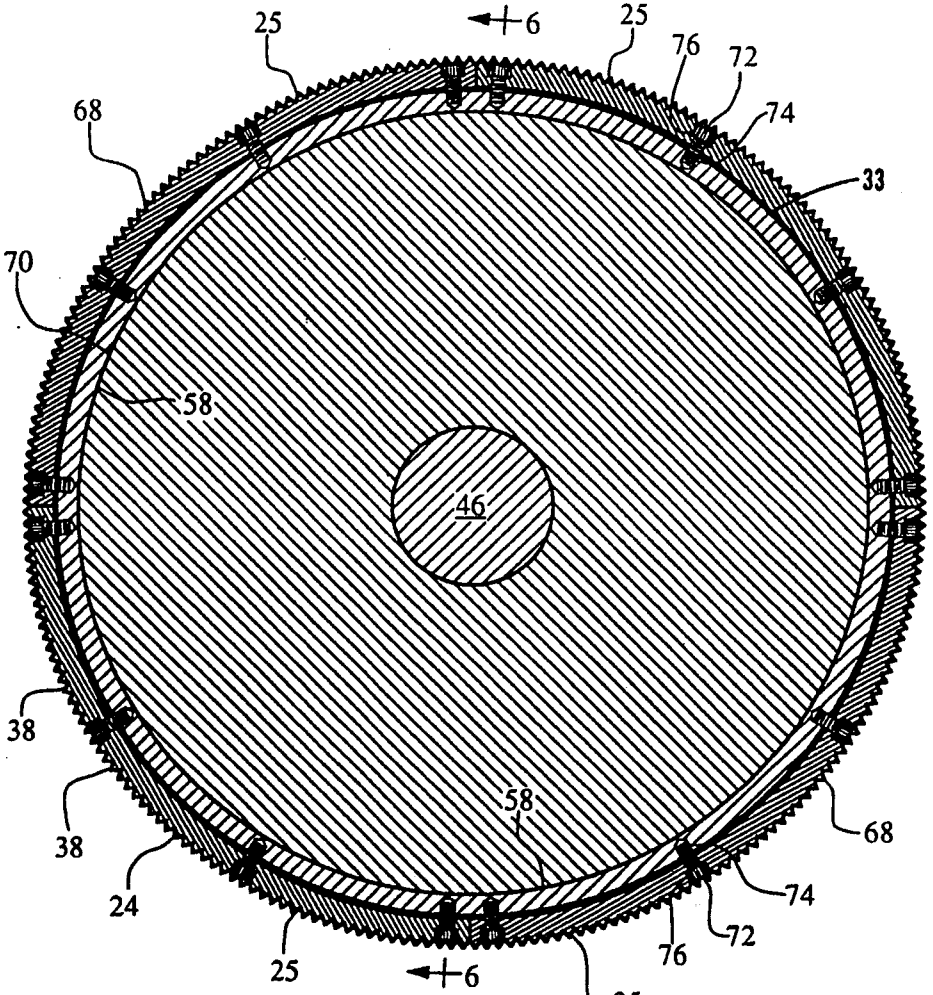
FIG. 5 is cross-sectional view of the roll of FIG. 6 taken along section line 5—5 showing a roll employed in the chip cracking apparatus of FIG. 1.
Figure 6:
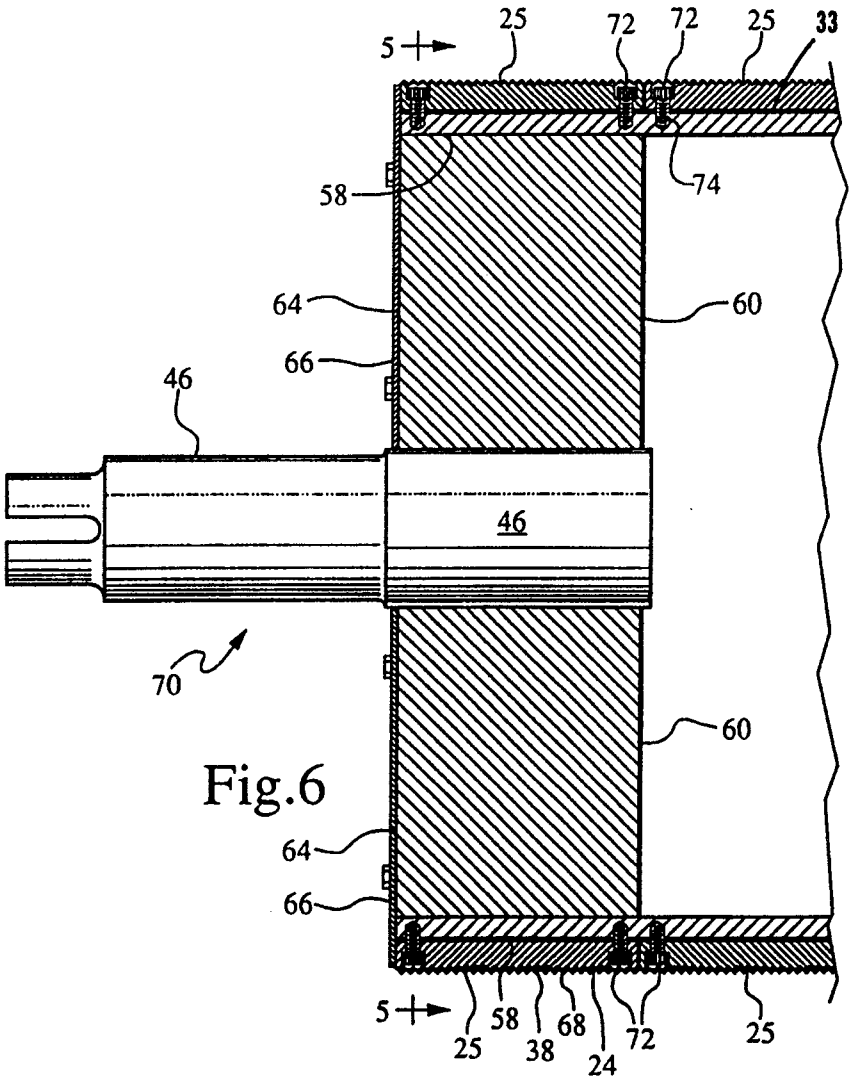
FIG. 6 is a fragmentary cross-sectional view of the roll of FIG. 5 taken along section line 6—6.

The rolls 24, 26 are constructed with an inner shell 58, shown in FIGS. 3, 5 and 6. The inner shell 58 is joined at its ends to end plates 60, shown in FIGS. 5 and 6. The end plates 60 are in turn joined to drive shafts 46. The ends 64 of the rolls 24, 26 are covered by end cover plates 66, as shown in FIGS. 5 and 6. The end cover plates 66 serve to align the first segments 68 with the ends 64 of the roll, thus facilitating the assembly of the segments 25 to the inner shell 58. The inner shell 58, end plates 60 and drive shafts 46 make up a central shaft assembly 70 to which the surface segments 25 are joined.

In the typical roll 24, shown in FIG. 3, a total of four surface segments 25 are required to encircle the circumference of a roll which is 37 inches (94 cm.) in diameter. An exemplary roll 24, as shown in FIG. 3, is four feet (122 cm.) long and contains four sets of adjacent circumferentially and axially extending surface segments 25, for a total of 16 individual surface segments. Each segment 25 is secured to the inner shell 58 by twelve hex-socket cap screws or bolts 72. The size of the surface segments 25 are chosen such that the weight of each segment can be handled by a single man and will typically weigh approximately one-hundred pounds (45 kg.).

The resilient material backing 33 is formed of polyurethane, preferably of 98 durometer and $\frac{1}{8}$ to $\frac{1}{4}$ inch thick. The backing may encircle the inner shell, but is preferably adhesively attached to the back of each segment 25, and removable with the segment. The backing 33, shown in FIGS. 3 and 5, provides a shock absorbing capability to improve the endurance of the contoured surface of the segment. In the event that an oversize piece of tramp metal passes through the nip 36, the backing 33 will give, preventing damage to the contoured surface of the segment 25. In a potentially catastrophic situation, for example, should a lag bolt or bar migrate into the chip flow stream, the backing will yield and prevent instantaneous destruction of the apparatus.

Paper manufacture is a capital-intensive industry. Further, although wood and wood chips are sometimes stock-piled before use, in the normal papermaking process there is a continuous flow of material from raw wood through to finished paper. The result of the high capital investment in the continuous processing of raw wood or chips to finish paper is the high cost associated with equipment downtime. Thus, it is highly desirable that papermaking equipment be designed to require infrequent maintenance and, when maintenance is necessary, to be rapidly repairable.

Further, it is critical to limit the number of personnel required to repair downed machinery. Because of the cost of shutting down a papermaking machine and its supporting wood chip and pulp processing machinery, it is desirable to perform maintenance simultaneously on all portions of the paper machine and its support equipment. Thus, because all parts of the machine must be worked on simultaneously, manpower is at a premium. Hiring an additional person to work on the maintenance of a papermaking machine and its support equipment during infrequent down times for repair or maintenance is not cost effective. Rather, the maintenance team must be drawn from personnel who perform other functions while the papermaking machinery and its support equipment are in operation.

The rolls 24, 26 are designed to meet these requirements of the papermaking industry by employing the removable roll surface segments 25. The surface segments 25 form the contoured surfaces 32, 34 of the rolls 24, 26 which in turn are used in the chip conditioner 20 to prepare over-thick wood chips. For wear resistance and strength, the surface segments 24 are constructed from 4140 steel which is spun-cast into a cylindrical shell rough casting. The interior surface of the shell is machined to match the diameter of the inner shell 58.

The outer surface of the cylindrical shell rough casting is machined to produce the highly aggressive contoured surface composed of a matrix of pyramids 38, shown in FIGS. 3 and 4.

Bolt holes 74 and countersunk spot faces 76 are machined into the casting. The segments 25 are then cut from the casting by a band saw with approximately a 60 thousandths of an inch (1.5 mm.) kerf. The individual segments 25 are heat-treated to develop strength. After heat treating, the segments 25 are hard-chrome plated 0.003 to 0.005 inch (0.076 to 0.127 mm.) thick to provide a hard, wear-resistant surface. The segments 25 are bolted with bolts 72 to the inner shell 58 to form the completed rolls 24, 26. The bolts 72 are recessed beneath the surfaces 32, 34, by the countersunk spot faces 76, so as not to interfere with the inter-meshing of the pyramids 38.

The expected life of the rolls 24, 26 is three years, with normal use. The chip conditioner 20 preferably will be used with an air density separator, electric magnets, or other devices to remove tramp metal from the chips prior to being processed by the chip conditioner 20. However, in the event tramp metal, particularly iron, is fed through the nip 36, the hydraulic actuators 48, responding to the greater load between the rolls, will allow the rolls to separate, thereby passing the offending metal through the rolls.

If the tramp metal has damaged the rolls 22, 24, the damage will normally be limited to a single or at most a few segments 25. These segments can be unbolted individually and replaced, normally by a single workman, without removing the rolls 24, 26 from the frame 30 of the chip conditioner 20.

The rolls 24, 26 are dynamically balanced to keep vibration to a minimum. Fluid couplings 78 are provided at the motor's ends for soft, cushioned starts. Increased motor starting torque can protect mechanically against motor overload.

The hydraulic system employed will preferable be of low pressure, for increased safety and to reduce leakage and provide quiet operation.

It should be understood that although the roll ends 64 are shown solid, they could be constructed of forgings or weldments having the appearance of a spoked wheel.

It also should be understood that, although the segments 25 are described as cut from a larger cylindrical casting, the individual segments could be formed from individual segment castings. The segments could also be machined from rolled plate or built-up weldments.

It also should be understood that, although the surface segments 25 are shown to abut each other, they could have lapped joints.

It also should be understood that, although hexsocket bolts are shown, other types of bolts, removable pins, and locking mechanisms could be used.

It is understood that the invention is not confined to the particular construction and arrangement of parts herein illustrated and describe, but embraces such modified forms thereof as come within the scope of the following claims.

I claim:

1. An apparatus for destructuring wood chips comprising:

a frame;

a first roll mounted to the frame for rotation about a first axis, wherein the first roll has an inner shell, and a plurality of semicylindrical segments having an outer contoured surface are connected to the inner shell, and wherein a resilient material is positioned between the segments and the inner shell; and a second roll mounted to the frame for rotation about an axis parallel to the first axis, wherein the first and second rolls are spaced from each other a preselected distance for applying compressive force to wood chips passing therebetween, and wherein the first roll contoured roll surface is formed by a matrix of outwardly extending projections which define an aggressively contoured roll surface, causing the chips to be cracked primarily in a direction parallel to the chip fibers as compressive force is applied thereto when the chips pass between the first and second rolls.

2. The apparatus of claim 1 wherein the resilient material comprises a polyurethane layer adhesively attached to the segments, and the segments with attached resilient material are bolted to the inner shell.

3. In an apparatus for destructuring wood chips having first and second cylindrical rolls disposed for rotational operation substantially parallel to each other, and spaced from each other a pre-selected distance for applying compressive force to wood chips passing therebetween;

means for supplying a flow of wood chips to the space between the first and second rolls and for distributing the wood chips along the axial extent of the first and second rolls, at least one of the first and second rolls being connected to means for rotating the at least one roll along its longitudinal axis; and at least the first roll having an aggressively contoured roll surface including a matrix of outwardly extending discrete projections, the projections being of a height substantially equivalent to the desired chip thickness; wherein the improvement comprises:

a resilient material positioned between an inner shell and a plurality of rigid surface segments which define the aggressively contoured roll surface, the resilient material and segments being releasably fastened to the inner shell.

4. An apparatus for destructuring wood chips comprising: a frame;

first and second cylindrical inner shells rotatably mounted to the frame about parallel rotational axes;

a plurality of rigid surface segments releasably mounted to each inner shell, each segment having an outer surface formed by a matrix of outwardly extending projections, wherein the segments are releasably connected to the first and second inner shells, and wherein the first and second inner shells are spaced from each other a pre-selected distance such that the segments apply a compressive force to wood chips which pass between the two shells with segments mounted thereon, causing the chips to be cracked primarily in a direction parallel to the chip fibers as compressive force is applied thereto; and a resilient material positioned between the segments and each inner shell.

5. The apparatus of claim 4 wherein the resilient material is affixed to the segments, and the segments with attached resilient material are bolted to the inner shells.

* * * * *